US006236622B1

(12) United States Patent
Blackman

(10) Patent No.: US 6,236,622 B1
(45) Date of Patent: May 22, 2001

(54) LAMP AND ALARM CLOCK WITH GRADUALLY INCREASING LIGHT OR SOUNDS

(75) Inventor: Stephen E. Blackman, Florham, NJ (US)

(73) Assignee: Verilux, Inc., Stamford, CT (US)

( * ) Notice: Subject to any disclaimer, the term of this patent is extended or adjusted under 35 U.S.C. 154(b) by 0 days.

(21) Appl. No.: 09/303,392

(22) Filed: May 1, 1999

(51) Int. Cl.[7] ..... G04B 47/00; G04B 23/02; G04B 19/00; F21V 33/00

(52) U.S. Cl. ..... 368/10; 368/72; 368/79; 368/256; 362/253

(58) Field of Search ..... 368/10, 72–75, 368/79, 250, 251, 252; 362/84, 86, 103, 226, 228, 234, 251, 253

(56) References Cited

U.S. PATENT DOCUMENTS 1,943,598 * 1/1934 Gourlet .
4,038,561 * 7/1977 Lorenz ..... 307/141
4,481,852 * 11/1984 Makuta et al. ..... 84/1.03
5,008,865 * 4/1991 Shaffer et al. ..... 368/10
5,055,986 * 10/1991 Johnson ..... 362/253
5,195,064 * 3/1993 Hegarty et al. ..... 368/272
5,212,672 * 5/1993 Loisch et al. ..... 368/79
5,379,273 * 1/1995 Horiner ..... 368/73
5,926,440 * 7/1999 Chien ..... 368/10

* cited by examiner

*Primary Examiner*—Vit Miska
(74) *Attorney, Agent, or Firm*—St. Onge Steward Johnston & Reens LLC

(57) ABSTRACT

A lighting fixture having a lamp and alarm clock with a wake-up cycle and sleep cycle with gradually increasing and decreasing light and sounds. The lighting fixture includes at least one lamp for emitting light in the wake-up cycle and in the sleep cycle. The lighting fixture also includes at least one speaker for emitting sound in the wake-up cycle and in the sleep cycle. The lighting fixture further includes a dimmer switch for dimming the light and wake-up cycle control buttons for setting and controlling a wake-up cycle having a light control button for setting the time when the wake-up cycle control buttons activates the light mode and gradually increases the lamp brightness emitted from the at least one lamp; and sound control buttons for setting and controlling the time when the wake-up cycle control buttons activates the sound mode and gradually increases the sound intensity emitted from the at least one speaker; and sound selection switches for selecting one of multiple pre-set sounds for the sound mode of the wake-up cycle, or for full time operation as background sound.

25 Claims, 8 Drawing Sheets

LAMP AND ALARM CLOCK WITH GRADUALLY INCREASING LIGHT OR SOUNDS

FIELD OF THE INVENTION

The present invention relates to a lamp having soothing audio sounds selected from natural environments being integrated with a conventional alarm clock-radio. More particularly, the lamp provides a plurality of soothing sounds selected from nature or natural environments which the user can choose from, such that the soothing sound gradually increases or decreases in volume over a preset period of time. Additionally, the lamp also simulates a natural sunrise or sunset, where the light source slowly increases or decreases its illumination over a preset period of time.

BACKGROUND OF THE INVENTION

The human body is very sensitive and responsive to external environmental conditions of surrounding sounds, light, temperature and room smell (odors) during the process of waking up or falling asleep in one's home. Various products have been developed to provide stress free and relaxing methods of waking up and falling asleep by using soft music, gentle sounds and changing the brightness of a light source.

There are several companies today that provide devices that produce soothing background sounds, where the user can choose between sounds selections, and also vary the listening level.

Additionally, some of these devices also allow the user to program these sounds to wake them up at a certain time and also gradually fade the sounds out over a certain period of time.

Additionally, there are also manufacturers that are offering lighting fixtures that will simulate a sunrise to wake up the user using the light intensity that starts at low brightness and gradually increases light intensity until it reaches full brightness. The fixture will also decrease in brightness.

There is no single product that provides a natural environment lamp having sunrise and sunset features, sound features and alarm and fade features, as shown in the present invention. There remains a need for a lamp having a plurality of soothing audio sounds selected from nature or natural environments, such as the ocean surf, the wind blowing chimes, or birds singing, being integrated with a standard alarm clock or a standard alarm clock-radio. The lamp would also include the plurality of soothing sounds which will gradually increase or decrease in volume over a period of time. Additionally, the lamp simulates a natural sunrise or sunset, where the light source will slowly increase or decrease its illumination over a preset period of time. The lamp also provides a standard beeping alarm and clock-radio, allowing the user to choose any combination of soothing sound, increasing or decreasing light and/or beeping alarm in order to assist the user in waking up or falling asleep.

DESCRIPTION OF THE PRIOR ART

Alarm clock/radio devices, alarm systems in conjunction with lighting sources (lamps), timing control devices, and the like having various designs, structure, configurations and functions have been disclosed in the prior art. For example, U.S. Pat. No. 3,798,889 to CHADWICK discloses a light and alarm system, for operation with a timer mechanism, whereby a lamp will increase in brilliance with the passage of time until full illumination is reached to simulate a natural sunrise. A clock dial is aligned with a programmer cylinder, and light from a bulb passes through a notch to contact a light sensitive resistor, thereby activating a circuit, which sends a signal to an exterior bulb. As the amount of light passing through the slot or notch increases, the electrical signal to the bulb becomes stronger. The bulb thus gradually increases in illumination thereby simulating a natural sunrise.

U.S. Pat. No. 5,243,568 to BURCH discloses a clock/radio, which contains an electronic circuit, that works in conjunction with the time-setting mechanism and the audio system of the clock/radio. This device is designed to awaken a sleeping person in a natural, gradual, and pleasant manner. The circuitry causes the lamp to come on at low intensity before the actual time that the sleeper wants to awaken. The light intensity increases gradually and this light is sensed by a light sensor which is embedded in the case of the clock/radio and is connected to the sound system. The light sensor then causes the sound of the radio to be activated and to increase gradually in volume. This combination of gradually increasing light plus gradually increasing sound volume will awaken a sleeper gently. This avoids the problem of sudden shocks of light or sound to one who is sleeping.

U.S. Pat. No. 5,008,865 to SHAFFER is also directed to a light source with gradually changing intensity which is driven by a time-setting mechanism in a clock/radio. The user can manually select the time interval over which the light intensity increases, but it will usually be in the range of 30 minutes to an hour.

U.S. Pat. No. 5,212,672 to LOISCH et al discloses a timing control apparatus for actuating one or more remote devices, including a lamp. The timer is separate from the remote devices, which can include a radio. A plurality of clock pulses gradually increasing over time causes an electrical current to increase, thereby gradually increasing light, sound, or even smell from the remote devices. This in turn gently awakens the user.

None of the prior art patents disclose or teach a lamp that provides the use of preselected soothing sounds to gradually awaken the user while sleeping, in combination with a light source which simulates a natural sunrise, where the lamp will slowly increase illumination over a preset period of time. Additionally, none of the prior art patents disclose or teach a lamp integrated with a conventional alarm and/or clock-radio which has preselected soothing sounds selected from nature so the user can choose any combination of soothing sound, increasing or decreasing light, beeping alarm and/or radio music in order to assist the user in waking up or falling asleep.

Accordingly, it is an object of the present invention to provide a table lamp having soothing audio sounds selected from natural environments, and increasing and decreasing lighting to simulate sunset and sunrise, being integrated with a conventional alarm clock-radio.

Another object of the present invention is to provide a table lamp having a plurality of preselected soothing audio sounds from natural environments selected from the group consisting of the ocean surf breaking on the beach, water falls, a babbling brook, trees rustling in the wind, rain drops splattering on a surface, the wind blowing chimes, church bells, birds singing, wolves howling, crickets chirping, rhythmic chanting, heart beats and the like.

Another object of the present invention is to provide a table lamp that simulates a natural sunrise or sunset, where the light source slowly increases or decreases its illumination over a preset period of time.

Another object of the present invention is to provide a table lamp that combines the sunrise and sunset lighting features with the sound rising and sound setting audio features, along with other special alarm and fade features in giving the user a stress free method of waking up and falling asleep with the use of gently changing light and sound.

Another object of the present invention is to provide a table lamp that has reduced glare for better reading; and an easy-to-use control panel having a built-in digital clock display that provides the time of day and also allows the user to precisely set the alarm features.

Another object of the present invention is to provide a reduced glare table lamp having the capability of emitting different background sounds that also includes a standard beeping alarm and clock-radio which allows the user to choose any combination of soothing sound, increasing or decreasing light, beeping alarm, or radio music in order to assist in waking up the user or helping the user fall asleep.

A further object of the present invention is to provide a table lamp having an alarm clock-radio with gradually increasing light and/or sounds that can be mass produced in an automated and economical manner and is readily affordable by the user.

SUMMARY OF THE INVENTION

In accordance with the present invention, there is provided a lighting fixture having a lamp and alarm clock with a wake-up cycle and a sleep cycle with gradually increasing and decreasing light and sounds. The lighting fixture includes at least one lamp for emitting light in the wake-up cycle and in the sleep cycle. The lighting fixture also includes at least one speaker for emitting sound in the wake-up cycle and in the sleep cycle. The lighting fixture further includes a dimmer switch for dimming the light and wake-up cycle control buttons for setting and controlling a wake-up cycle having a light control button for setting the time when the wake-up cycle control buttons activates the light mode and gradually increases the lamp brightness emitted from the at least one lamp; and sound control buttons for setting and controlling the time when the wake-up cycle control buttons activates the sound mode and gradually increases the sound intensity emitted from the at least one speaker; and sound selection switches for selecting one of multiple pre-set sounds for the sound mode of the wake-up cycle; or for full time operation as background sound. The lighting fixture further includes sleep cycle control buttons for setting and controlling a sleep cycle having a light control button for setting the time when the sleep cycle control buttons activates the light mode and gradually decreases the lamp brightness emitted from the at least one lamp; and sound control buttons for setting and controlling the time when the sleep cycle control buttons activates the sound mode and gradually decreases the sound intensity emitted from the at least one speaker; and sound selection switches for selecting one of multiple pre-set sounds for the sound mode of the sleep cycle. Additionally, the lighting fixture includes an electrical PC board connected to the wake-up cycle control buttons and to the sleep cycle control buttons for supplying electrical power thereto.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED AND ALTERNATE EMBODIMENTS

OVERVIEW

Figure 2:
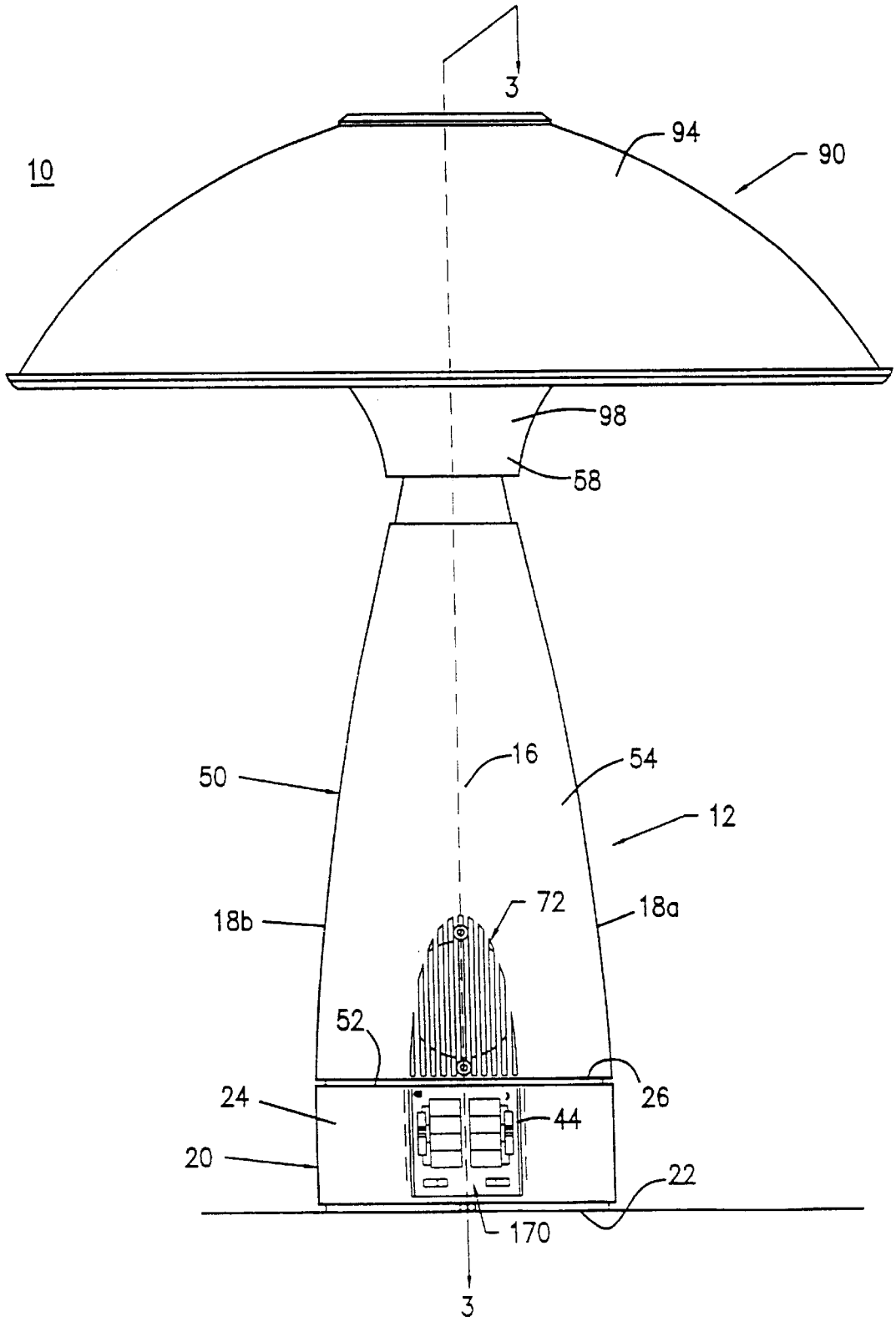
FIG. 2 is a rear elevational view of the table lamp of the present invention showing the table lamp housing having a shade, a lamp column with an audio speaker section, and a lamp base with a second control panel for adjusting the lighting display, the length of time for the audio, the type of soothing sound and the type of alarm.
Figure 3:
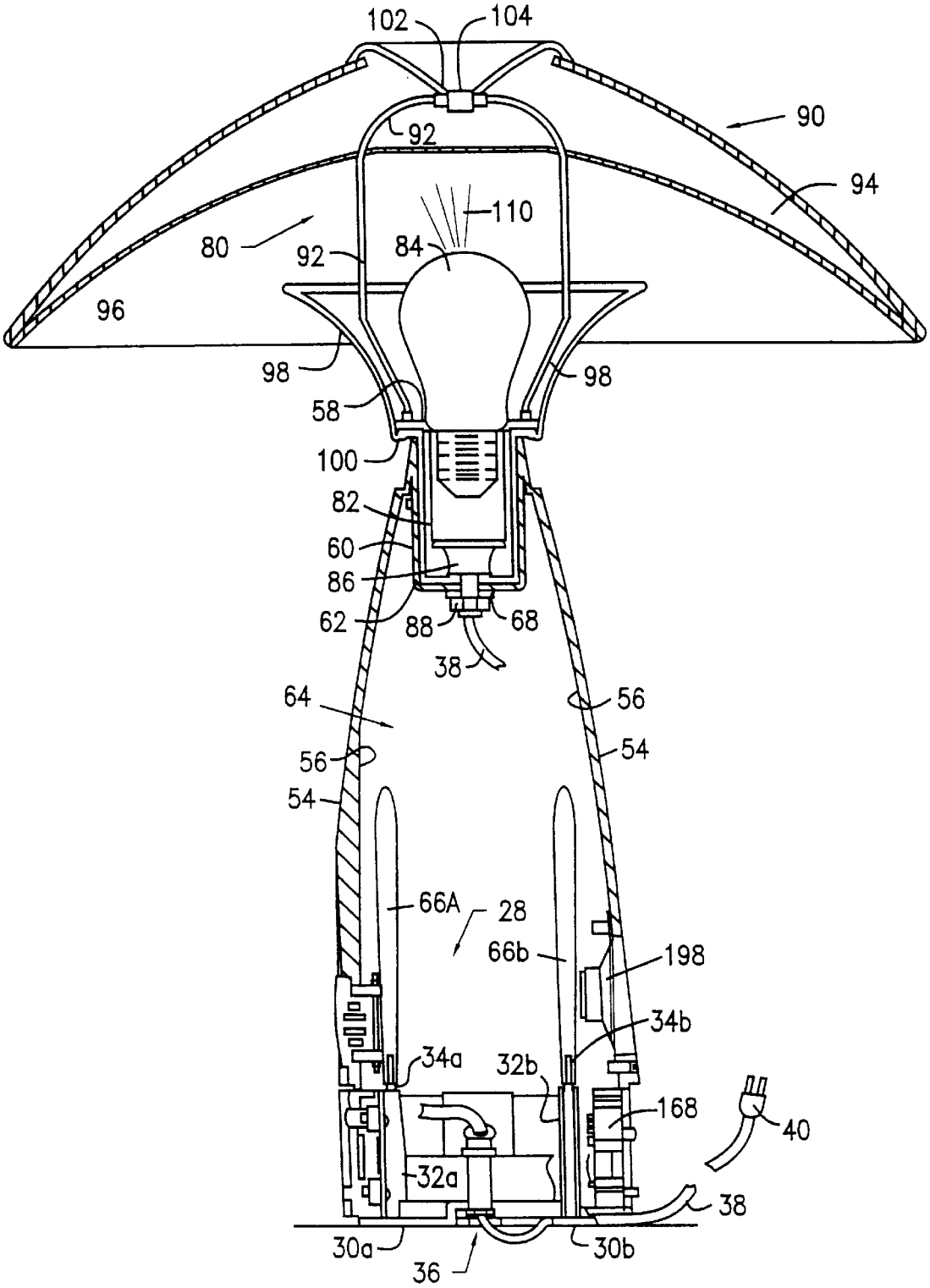
FIG. 3 is a cross-sectional view of the table lamp of the present invention taken along lines 3—3 of FIGS. 1 and 2 showing the major component parts contained therein.
Figure 4:
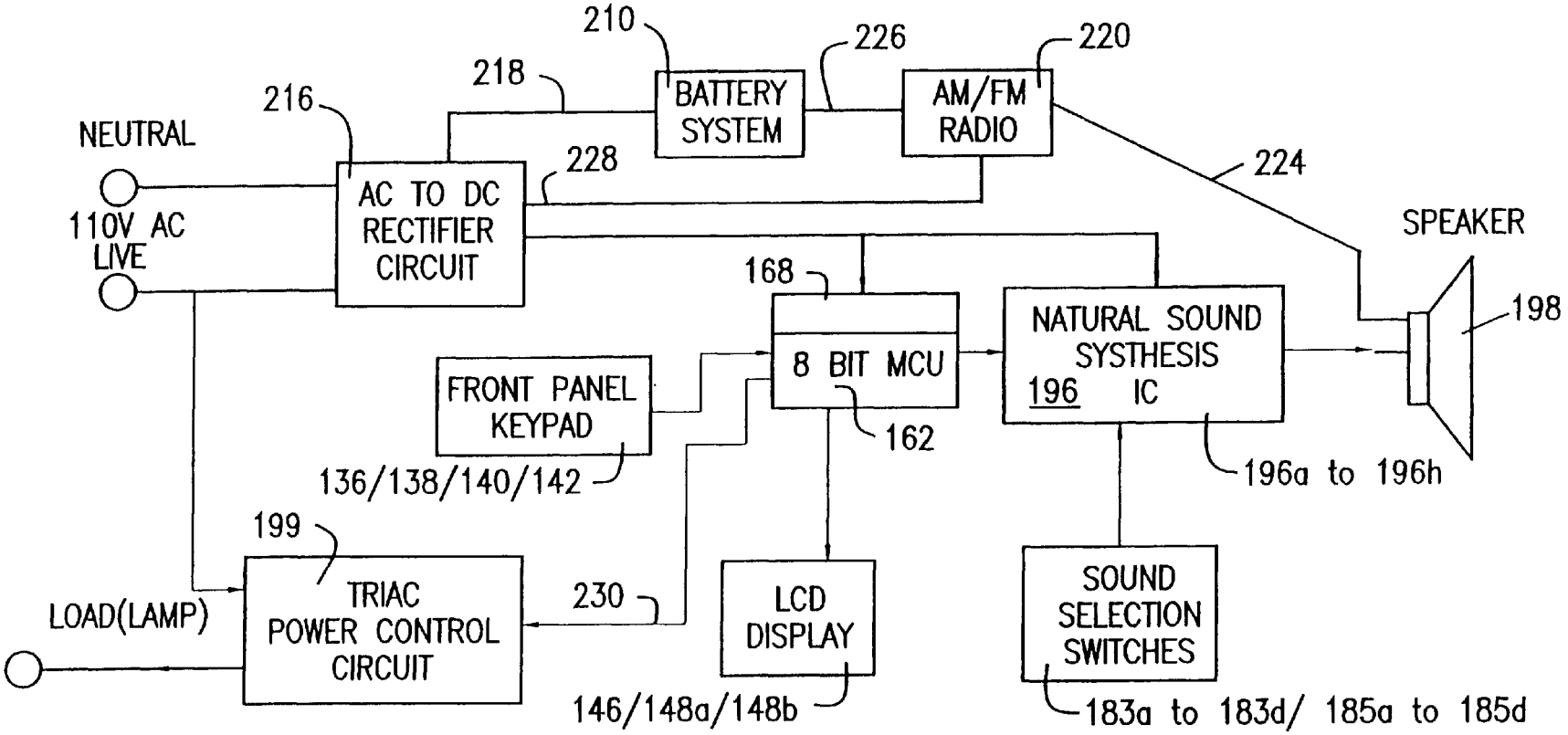
FIG. 4 is an electrical schematic diagram of the table lamp of the present invention showing the electrical circuit.
Figure 5:
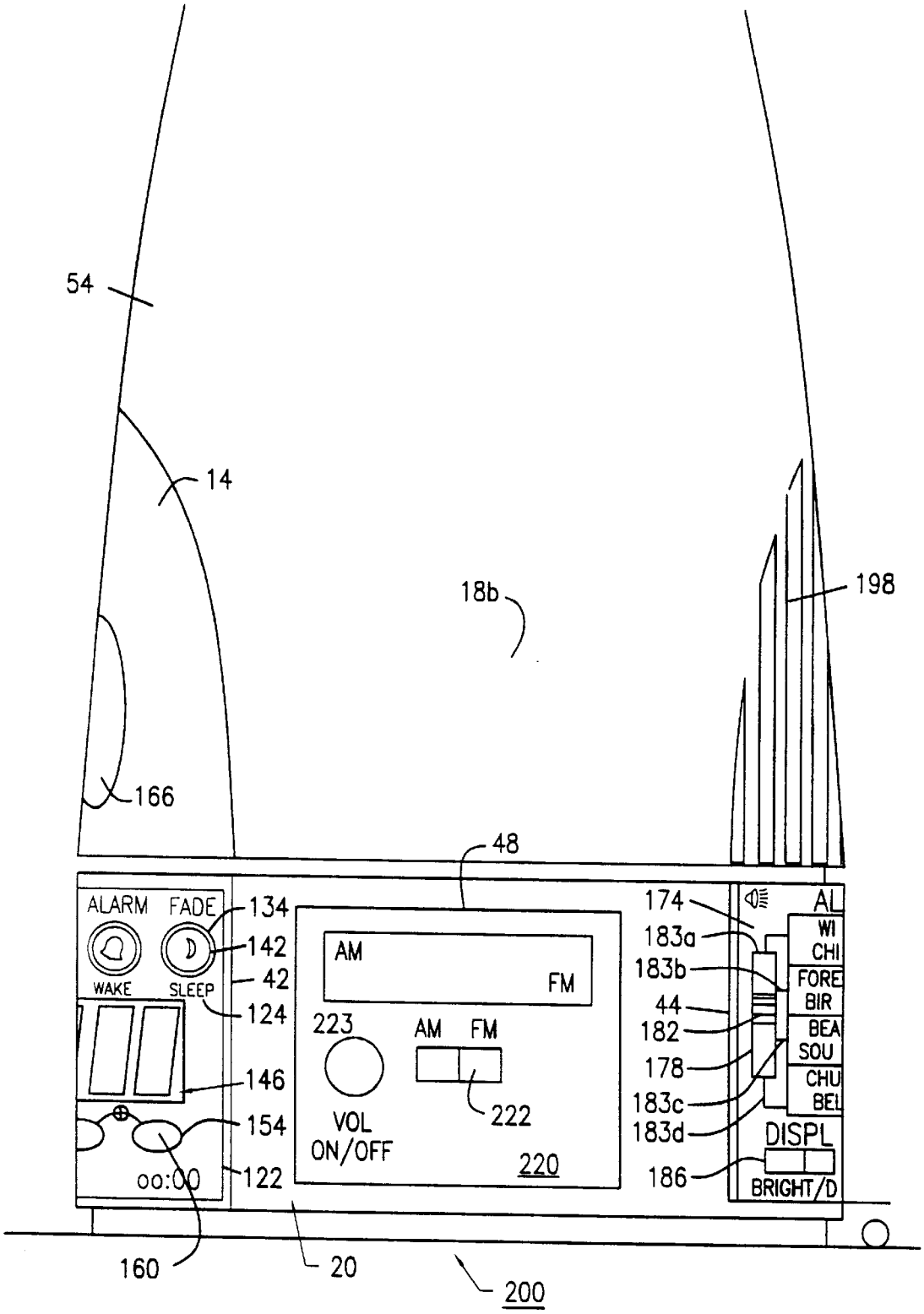
FIG. 5 is an enlarged front elevational view of the table lamp of the alternate embodiment of the present invention showing the light and sound control buttons, the control panel, and the AM/FM radio component thereon.
Figure 6:
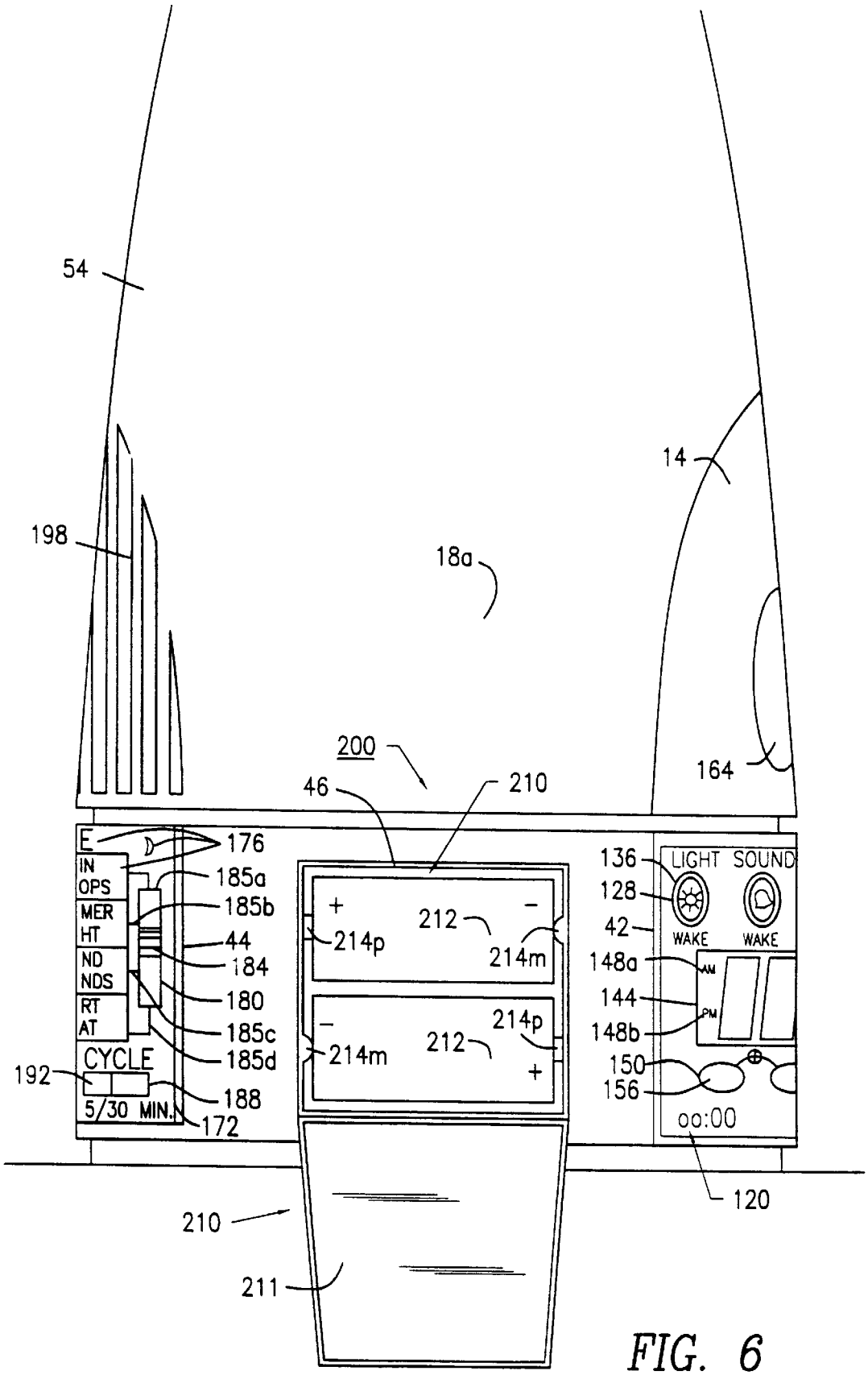
FIG. 6 is an enlarged rear elevational view of the table lamp of the alternate embodiment of the present invention showing the battery compartment, the speaker section and the second control panel in further detail.

The natural environment table lamps 10 and 200, and their component parts, of the preferred and alternate embodiments of the present invention are represented in detail by FIGS. 1 through 6 of the patent drawings. The table lamp 10 of the preferred embodiment, as shown in FIGS. 1 to 4 of the drawings, is a conventional lamp and alarm clock with gradually increasing and decreasing light and sounds. The table lamp 200 of the alternate embodiments, as shown in FIGS. 4 to 6 of the drawings, includes optional features of a battery back-up system 210 for providing power to the clock and alarm during a power blackout; and an AM/FM radio 220 for providing music, news, etc. to the table lamp 200. In all other respects, the table lamp 200 of the alternate embodiment is structurally the same, and functions and operates in the same manner as the table lamp 10 of the preferred embodiment.

PREFERRED EMBODIMENT 10

The natural environment table lamp 10 and its component parts of the preferred embodiment of the present invention are represented in detail by FIGS. 1 to 4. The table lamp 10 includes a lamp housing 12 having a base stand 20, a lamp column 50, a lighting assembly 80, a lamp shade assembly 90, a first control panel system 120 for providing a selectional format of light and sound functions, control buttons 164 and 166 for light and sound, and a second control panel system 170 for providing specific alarm, fade and clock functions and various types of soothing sounds. These soothing sounds are selected from the group consisting of the ocean surf breaking on the beach, water falls, a babbling brook, trees rustling in the wind, rain drops splattering on a surface, the wind blowing chimes, church bells, birds singing, nighttime noises, wolves howling, crickets chirping, rhythmic chanting, heart beats, a baby cooing and the like.

Figure 1:
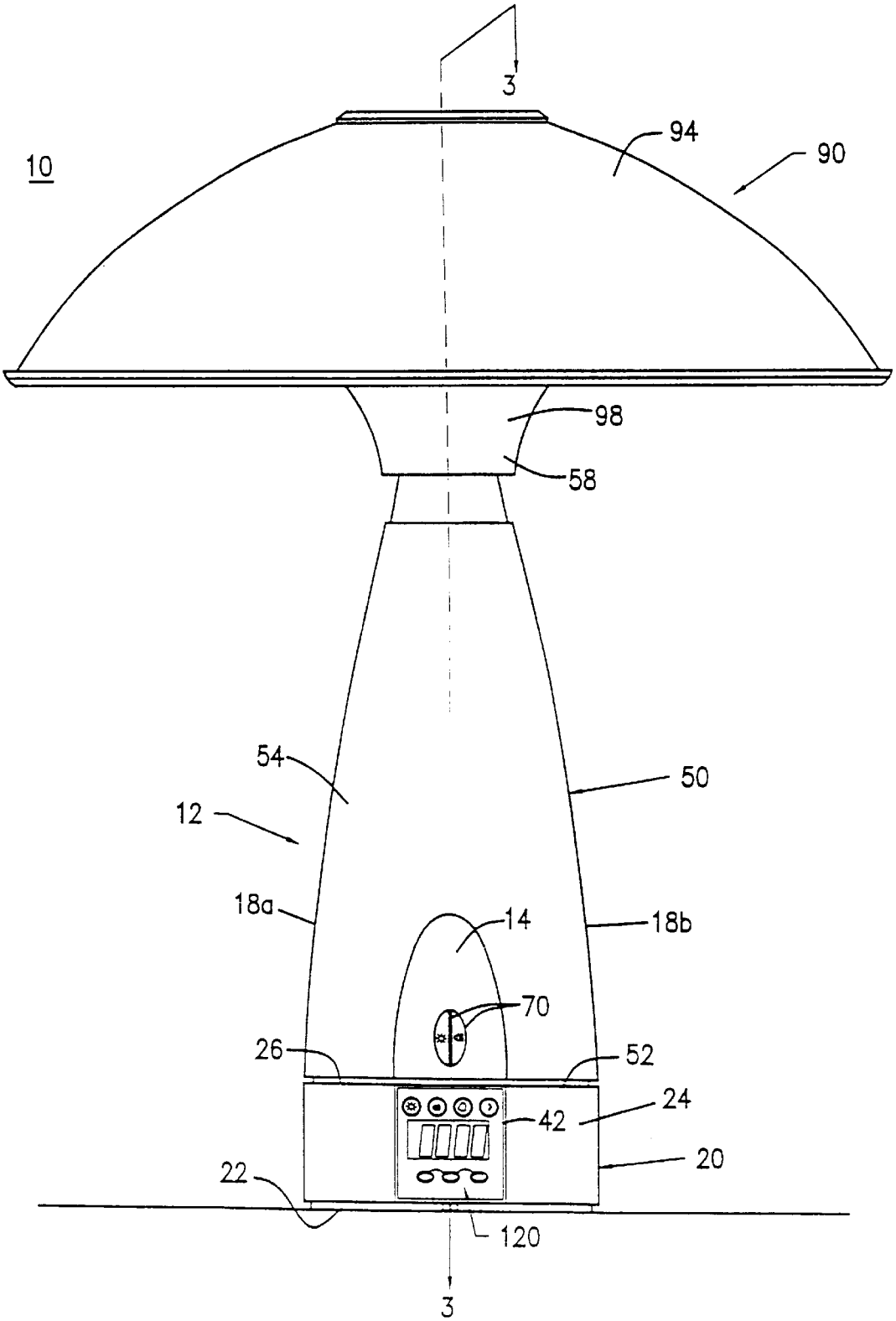
FIG. 1 is a front elevational view of the table lamp of the preferred embodiment of the present invention showing the table lamp housing having a shade, a lamp column with light and sound controls, and a lamp base with a first control panel for adjusting the soothing audio sounds, increasing or decreasing the light source, and for setting the alarm clock.

The base stand 20, as shown in FIGS. 1 and 2, includes a bottom wall 22, an outer cylindrical wall 24, an upper circular perimeter edge 26, and an inner compartment area 28. Bottom wall 22 includes a pair of retainer openings 30*a* and 30*b* being integrally attached to a pair of base stand cylindrical retainer posts 32*a* and 32*b* for receiving therein housing retainer screws 34*a* and 34*b*, respectively. Retainer openings 30*a* and 30*b* are diametrically opposed (180°) to each other. Bottom wall 22 also includes a centrally located circular opening 36 for receiving therein electrical cord 38 with an AC plug 40. Outer cylindrical wall 24 includes a first rectangular-shaped opening 42 for receiving therein the first control panel housing 122 of the first control panel system 120; and a second rectangular-shaped opening 44 for receiving therein the second control panel housing 172 of the second control panel system 170. Openings 42 and 44 are diametrically opposed (180°) with each other, such that opening 42 having therein the first control panel system 120 is the front side 14 of table lamp 10, and conversely, opening 44 having therein the second control panel system 170 in the rear side 16 of table lamp 10.

Figure 1A:
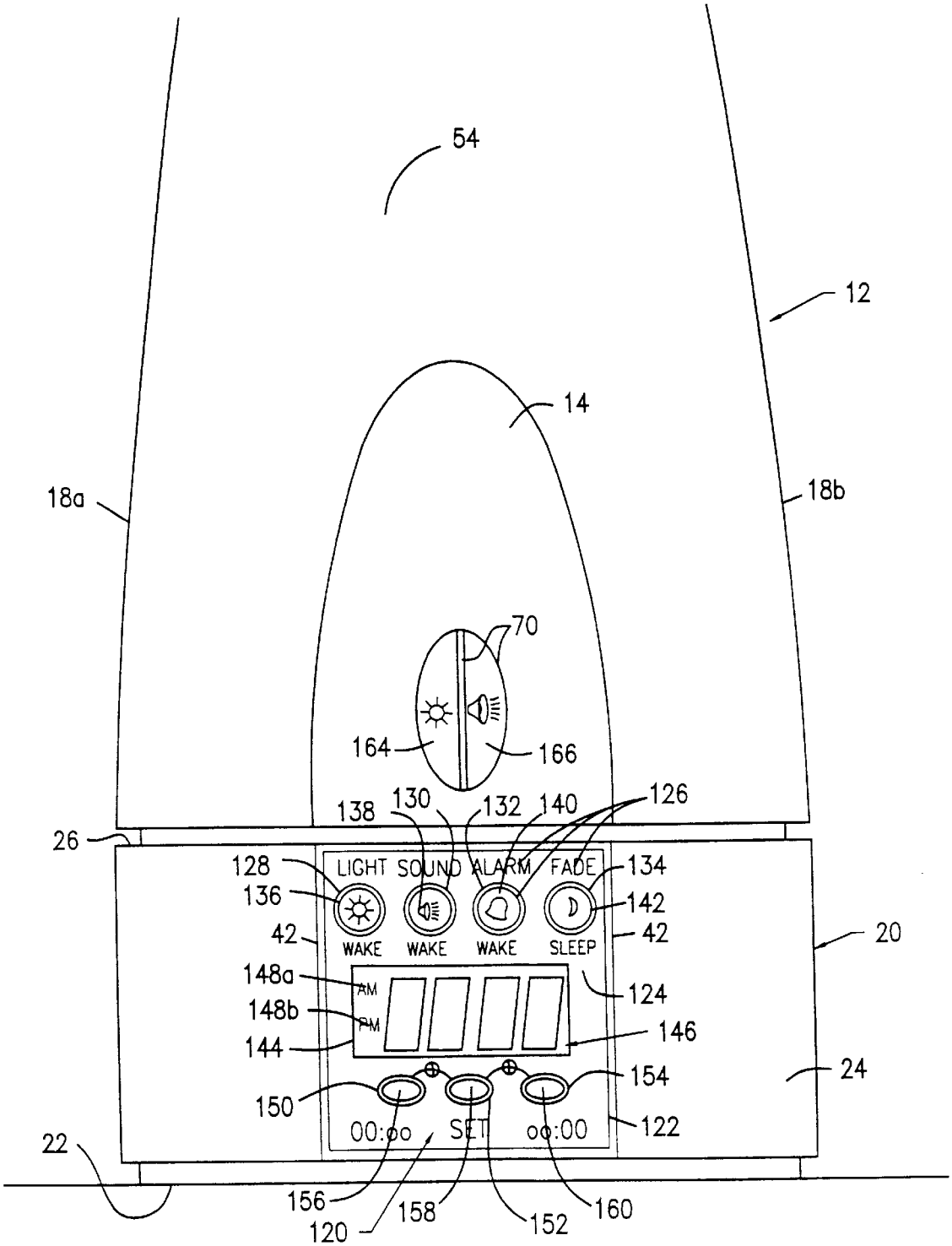
FIG. 1A is an enlarged front elevational view of the table lamp of the present invention showing the light and sound control buttons and the control panel in further detail.
Figure 2A:
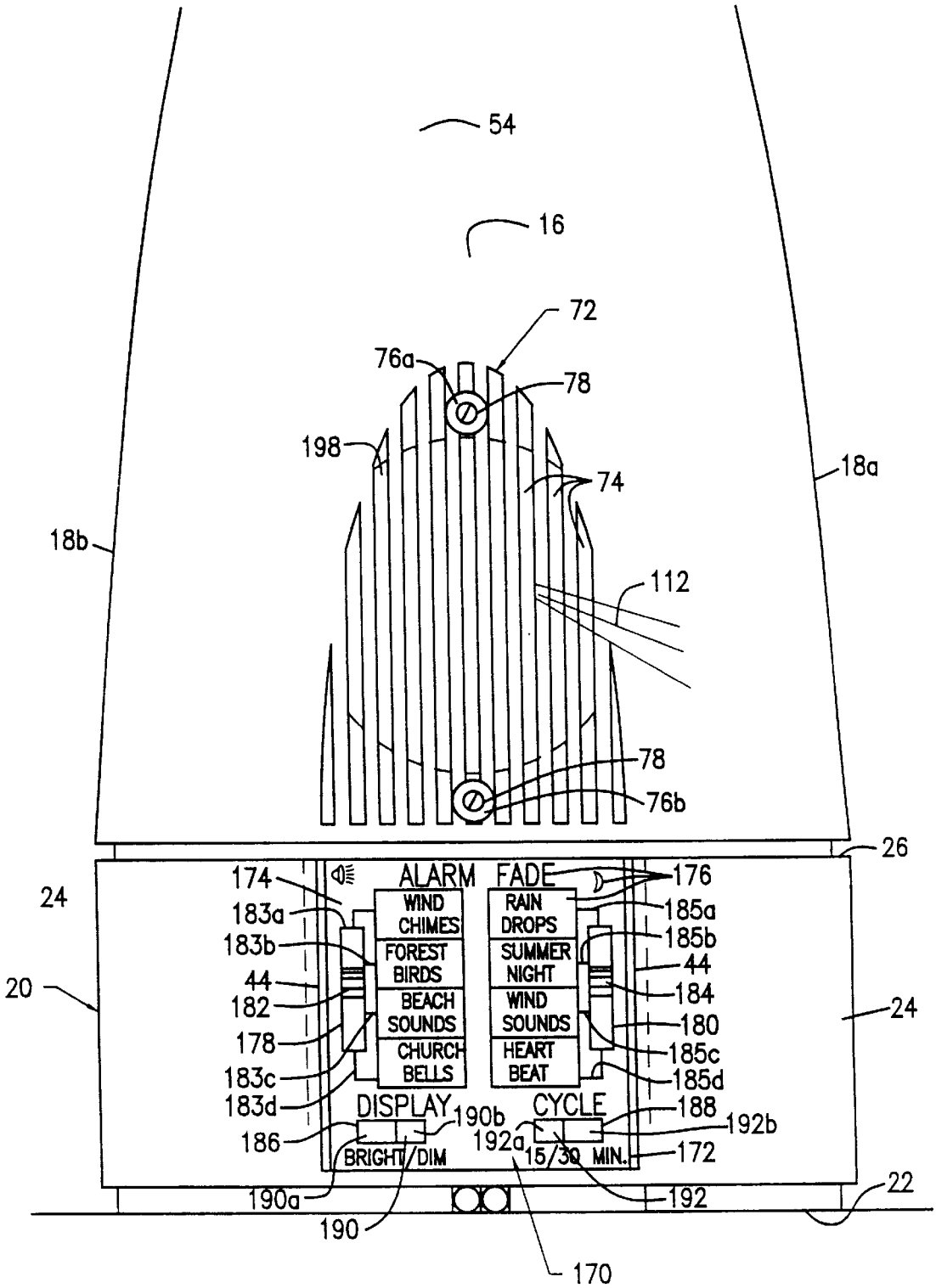
FIG. 2A is an enlarged rear elevational view of the table lamp of the present invention showing the speaker section and the second control panel in further detail.

The lamp column 50 includes, as shown in FIGS. 1 and 2, a lower circular perimeter edge 52, an outer conical surface wall 54, an inner conical surface wall 56, an upper circular perimeter edge 58, an upper socket compartment 60 having a bottom inner wall 62 and an inner lamp column compartment area 64. Lamp column 50 also includes two pairs of lamp column cylindrical retainer posts 66*a* and 66*b* being attached to the inner conical surface wall 56. Retainer posts 66*a* and 66*b* are also diametrically opposed (180°) with each other, such that retainer posts 66*a* and 66*b* are vertically aligned with that of retainer posts 32*a* and 32*b*, respectively, for receiving therein housing retainer screws 34*a* and 34*b*. In this manner, screws 34*a* and 34*b* provide for holding and connecting of the lamp column 50 to the base stand 20 to form the lamp housing 12. Bottom inner wall 62 of socket compartment 60 includes a centrally located circular opening 68 for electrical cord 38. Conical surface wall 54 includes an elliptical-shaped opening 70 for control buttons 164 and 166; and a substantially curved opening speaker area 72 having a plurality of slotted openings 74 for releasing the audio sound-waves 112 from speaker 198. Speaker area 72 includes a pair of circular recessed hole openings 76*a* and 76*b* for receiving therein slotted screws 78 in order to hold in place speaker 198 against the inner conical surface wall 56. Oval-shaped opening 70 and speaker area 72 are diametrically opposed (180°) with each other. Oval-shaped opening 70, having control buttons 164 and 166 therein, is adjacent and vertically aligned with the opening 42 having the first control panel system 120 therein, which again represents the front side 14 of table lamp 10, as shown in FIG. 1A. Conversely, the speaker area 72 having the speaker 198 attached thereto is adjacent and vertically aligned with opening 44 having the second control panel system 170 therein, which again represent the rear side 16 of table lamp 10, as shown in FIG. 2A. Base stand 20 and lamp column 50 of lamp housing 12 can be made of materials selected from the group consisting of ceramics, plastics, light-weight metals, wood and combinations thereof.

Lighting assembly 80 includes a threaded socket 82 (or a non-threaded socket for fluorescent lamps—not shown) for holding a lamp light 84 therein, such as an incandescent light bulb, a socket mounting and holding member 86 and a retaining nut 88. Lighting sources 84 may include an incandescent light bulb, a fluorescent lamp, a neon lamp, a full spectrum light bulb, and the like. The socket holding member 86 is attached to the bottom inner wall 62 of a socket compartment 60 via opening 68, such that retaining nut 88 holds in place the socket 82 to the socket compartment 60 of lamp column 50, as shown in FIG. 3 of the drawings. Lamp shade 94 may be made of non-glare glass or fabric materials.

The lamp shade assembly 90 includes a harp wire (or frame support rods) 92 having a mounting member 102 thereon with a retainer nut 104 for holding in place lamp shade 94, an upper lamp shade reflector 96, a lower back lamp shade reflector 98, and a support rod plate 100 for connecting and holding in place the harp wire 92, as depicted in FIG. 3 of the drawings.

The first control panel system 120 includes a panel housing 122 having a front wall 124 with indicia 126 thereon. Front wall 124 includes a plurality of circular openings 128, 130, 132 and 134 for receiving therein a plurality of actuating buttons 136, 138, 140 and 142, respectively (toggle switches or switches can be used instead of buttons). Actuating buttons 136 to 142 provide a selectional format of light and sound functions for light (light button 136), sound (sound button 138), chime/alarm (chime button 140), and fade (fade button 142), respectively. Front wall 124 of panel housing 122 also includes a rectangular-shaped opening 144 for receiving therein the digital clock display component 146 having lighted AM and PM display modes 148*a* and 148*b*, respectively. Front wall 124 of panel housing 122 further includes a plurality of oval-shaped openings 150, 152 and 154 for receiving therein a plurality of clock set-control buttons 156, 158 and 160, respectively, for setting the hour, minute and AM/PM mode for a specific time setting of the digital clock display component 146. The hour mode selection is represented by the hour mode button 156, the set-control for the setting of a specific hour, minute and AM/PM mode is represented by the set-control button 158 and the minute mode selection is represented by the minute mode button 160. The panel control system 120 is electronically connected to a PC board 162 having an eight-bit MCU capacity, as shown in FIG. 4 of the drawings. The light control button 164 and the audio sound control button 166 are also electronically connected to the PC board 162 via the power control circuit board 168, as shown in FIG. 4.

The second control panel system 170 includes a panel housing 172 having a front wall 174 with indicia 176 thereon. Front wall 174 includes a pair of rectangular-shaped vertical openings 178 and 180 for receiving therein the alarm and fade sound selection switches 182 and 184, respectively. The sound selection switches 182 and 184 provide a selectional switch format of the alarm and fade functions of the audio sound aspect of the second control panel system 170. As shown in FIG. 2A, the alarm switch 182 has four switch settings/positions 183*a*, 183*b*, 183*c* and 183*d* representing alarm audio sounds 112 such as wind chimes (position 183*a*), forest birds (position 183*b*), beach sounds (position 183*c*), and church bells (position 183*d*), respectively; and the fade switch 184 also has four switch settings/positions 185*a*, 185*b*, 185*c* and 185*d* representing fade audio sounds 112 such as rain drops (position 185*a*), summer nights (position 185*b*), wind sounds (position 185*c*), and heart beats (position 185*d*), respectively. Each of these aforementioned alarm and fade audio sounds 112 at position settings 183*a* to 183*d* and 185*a* to 185*d* have corresponding sound synthesis chips 196*a*, 196*b*, 196*c*, 196*d*, 196*e*, 196*f*, 196*g* and 196*h* representing that particular sound 112 of wind chimes, forest birds, beach sounds, church bells, rain drops, summer nights, wind sounds, and heart beats, respectively.

Front wall 174 of panel housing 172 also includes a pair of rectangular-shaped horizontal openings 186 and 188 for receiving therein a bright/dim display switch 190 for lighting control of the digital clock display 146 (a dial knob or a push button could also be used instead of switch 190); and a cycle time switch 192 for controlling a specific period of time in which the light rays 110 from lamp 84 (a cycle time dial knob or a cycle time push button could also be used instead of switch 192). The audio sound waves 112 from speaker 198 will gradually increase or decrease during that specific period of time. The bright/dim display switch 190 includes a bright setting position 191*a* and a dim setting position 191*b*. The cycle time switch 192 includes a 15 minute cycle setting position 193*a* and a 30 minute cycle setting position 193*b* in which to control the alarm or fade audio sound 112 features of the second control panel 170.

As depicted in FIG. 4, these sound synthesis chips 196*a* to 196*h* are incorporated within a sound synthesis PC board 196, such that PC board 162 is electrically connected to the sound synthesis PC board 196; and the sound synthesis PC board 196 is electrically connected to speaker 198 for audible projecting of these sounds 112. These sound selection switch settings 183*a* to 183*d* and 185*a* to 185*d* are also electrically connected to the sound synthesis chips 196*a* to 196*h*, respectively, of the sound synthesis PC board 196, as previously described. The bright/dim display switch 190 and the time cycle switch 192 functions are also incorporated with the sound synthesis PC board 196. PC board 162 is electrically connected to TRIAC power control circuit 190 for providing power to the lighting/lamp assembly 80 via electrical line 230.

ALTERNATE EMBODIMENTS 200

The table lamp 200 of the alternate embodiments of the present invention are represented in detail by FIGS. 4 to 6 of the drawings. All aspects of the table lamp 200 of the alternate embodiments are exactly the same as the table lamp 10 of the preferred embodiment, except for the additional feature (optional) components of a battery compartment 210 received within the third rectangular-shaped opening 46 of base stand 20; and an AM/FM radio component 220 received within the fourth rectangular-shaped opening 48 of base stand 20. Openings 46 and 48 are diametrically opposed (180°) to each other and represent the side areas 18*a* and 18*b* of table lamp 200, respectively.

The battery compartment/back-up battery system 210 includes a cover 211, a plurality of batteries 212 and positive and negative posts 214*p* and 214*n* for energizing the batteries 212 in order to provide power to the alarm switch 182 and clock 146 during a power blackout in which to prevent loss of time on the digital clock display 146. The back-up battery system 210 also functions in supplying power to the AM/FM radio component 220, as well as control panels 120 and 170. The back-up battery system 210, as shown in FIG. 4 of the drawings, is electrically connected to the AC to DC rectifier circuit 216 via electrical line 218, as well as being electrically connected to the AM/FM radio component 220 via electrical line 226.

The AM/FM radio component 220 includes an AM/FM switch 222 and ON/OFF button 223; and is electrically connected to the speaker 198 via electrical line 224, as well as electrically connected to the back-up battery system 210 and the rectifier circuit 216, via electrical lines 226 and 228, respectively, as shown in FIG. 4.

Table lamp 10 or 200 may vary in size and type of lamp configuration and may also be changed, such that lamp 10 or 200 may be in the form of a floor lamp, a desk lamp, a ceiling lamp, a shelf lamp, a wall lamp, a portable lamp, or a travel clock with a lamp.

OPERATION OF THE INVENTION

In operation, the natural environment table lamps 10 and 200 of the preferred and alternate embodiments are readily put into operational use by simply adjusting the various control buttons 136 142, 156 to 160, 164 and 168, and switches 182, 184, 190 and 192 on both of the first and second control panel systems 120 and 170 by the user for the wake-up and/or sleep cycles of the table lamps 10 and 200. The user initially programs the digital clock display 146 to a correct known time via the use of the hour mode button 156, the minute mode button 160 and the set-control button 158.

Next the user would then select and push the actuating light, sound, chime and/or fade buttons 136 to 142; and set each one of those above mentioned actuating buttons 136 to 142 via the set-control buttons 156 to 160 for setting a specific time on the first control panel system 120 in order for the user to choose any combination of soothing sound 112, increasing or decreasing light 110, beeping alarm, and/or radio music in order to assist the user in waking up or falling asleep.

Also, the user selects and pushes the light and/or audio sound control buttons 164 and/or 166 in order to activate light and/or sound to an "ON" or "OFF" position, as well as to increase or decrease light and/or sound modes. These light and audio sound buttons 164 and 166 afford the user the option of selecting a wake-up and/or fall asleep mode when using table lamps 10 or 200. Alternatively, table lamps 10 or 200 may be used for standard lighting 110 for reading and/or listening to music or soothing sounds 112 for background audio in order to relax the user from stress.

The user then selects and switches to the specific sound selection mode from the second control panel system 170 using the alarm selection switch 182 and/or the fade selection switch 184. Also, the user may then select and switch to either a 15 minute or 30 minute cycle position 193*a* or 193*b* using the cycle time switch 192 from the second control panel system 170 in order to hear a specific sound from the wake selection and/or the fade selection functions.

The user has a number of options for programming the table lamps 10 or 200 using the first and second control panel systems 120 and 170. For example, the user can specifically program a wake-up cycle in which the light 110 from lamp 84 will gradually increase over a thirty minute cycle, along with the alarm sound 112 gradually increasing in volume for a thirty minute cycle, such as beach sounds, in order to assist the user to simulate waking-up naturally. To set this wake-up cycle, the user selects and pushes light button 136, and sets time buttons 156 and 160, for example at 7:30 a.m., and then actuates set control button 158 to set the time (7:30 a.m.) for turning on lamp light bulbs 84 at a low light 110 level, starting at 7:00 a.m. Next, the user selects and actuates the alarm switch 182 to have the sound increase, and sets the time buttons 156 and 160, for example at 7:30 a.m. Then the user actuates set control button 158 to set that time (7:30 a.m.) for turning on the alarm sound, which will start 7:00 a.m. Then the user selects the "beach sounds" setting 183*c* on alarm switch 182 to hear the increasing intensity of beach sounds, and sets the cycle switch 192 to a 30 minute cycle setting 192*b*. This will cause the beach sounds to begin to intensify in volume starting at 7:00 a.m. Thus, the wake-up cycle in this example actuates the light and sound to gradually begin increasing from 7:00 a.m. to 7:30 a.m., when the user desires to be awaken.

In another example, the user can specifically program a sleep cycle in which the light 110 from lamp 84 will gradually decrease over a 30 minute cycle, having a fading sound of rain drops decreasing in volume for a thirty minute cycle. The fade switch control 142 (whatever the sound that was on or chosen) will start to fade the sound at the intensity level previously determined by the user. Additionally, the light switch control 164 will also start to fade the light 110 intensity from the intensity level previously set by the user to a complete turning "OFF" of the light 110 from lamp 84 during a thirty minute cycle. To accomplish this sleep cycle, the user selects and pushes light button 136, and sets time buttons 156 and 160 for example at 11:00 p.m. and then actuates set control button 158 to set that time (11:00 p.m.) for turning on light bulb 84 (if lamp 84 was not "ON"). Then the user sets the display light switch 190 to the dim setting 190*b* and sets the cycle switch 192 to a 30 minute cycle setting 192*b* which will cause light bulb 84 to begin dimming at 11:00 p.m. and to be off at 11:30 p.m. Next, the user selects and actuates the fade button 142 to have the sound decrease, and sets the time buttons 156 and 160 for example at 11:00 p.m. Then the user actuates set control button 158 to set that time (11:00 p.m.) for turning on the fade sound. Then the user selects the "rain drops" setting 185*a* on fade switch 184 to hear the fading sounds of rain drops, and sets the cycle switch 192 to a 30 minute cycle setting 192*b*. This will cause the rain drop sounds to begin to fade away starting at 11:00 p.m. and will finish at 11:30 p.m., thus completing the sleep cycle by the user.

In a further example, the user can specifically program a sleep cycle in which the light 110 from lamp 84 will gradually decrease over a fifteen minute cycle, while having a fading sound of rain drops decreasing in volume for a thirty minute cycle. To accomplish this sleep cycle, the user selects and pushes light button 136, and sets time buttons 156 and 160, for example at 11:00 p.m., and then actuates set control button 158 to set that time (11:00 p.m.) for turning on light bulb 84. Then the user sets the display light switch 190 to the dim setting 190*b* and sets the cycle switch 192 to a 15 minute cycle setting 192*a* which will cause light bulb 84 to begin dimming at 11:00 p.m. and to be off at 11:15 p.m. Next, the user selects and actuates the fade button 142 to have the sound decrease, and sets the time buttons 156 and 160, for example at 11:05 p.m. Then the user actuates set control button 158 to set that time (11:05 p.m.) for turning on the fade sound. Then the user selects the "rain drops" setting 185*a* on fade switch 184 to hear the fading sounds of rain drops, and sets the cycle switch 192 to a 30 minute cycle setting 192*b*. This will cause the rain drop sounds to begin to fade away starting at 11:05 p.m., and to stop by 11:35 p.m., thus completing the sleep cycle by the user.

ADVANTAGE OF THE PRESENT INVENTION

Accordingly, an advantage of the present invention is that it provides for a table lamp having soothing audio sounds selected from natural environments, and increasing and decreasing lighting to simulate sunset and sunrise, being integrated with a conventional alarm clock-radio.

Another advantage of the present invention is that it provides for a table lamp having a plurality of preselected soothing audio sounds from natural environments selected from the group consisting of the ocean surf breaking on the beach, water falls, a babbling brook, trees rustling in the wind, rain drops splattering on a surface, the wind blowing chimes, church bells, birds singing, wolves howling, crickets chirping, heart beats, rhythmic chanting and the like.

Another advantage of the present invention is that it provides for a table lamp that simulates a natural sunrise or sunset, where the light source slowly increases or decreases its illumination over a preset period of time.

Another advantage of the present invention is that it provides for a table lamp that combines the sunrise and sunset lighting features with the sound rising and sound setting audio features, along with other special alarm and fade features in giving the user a stress free method of waking up and falling asleep with the use gently changing light and sound.

Another advantage of the present invention is that it provides for a table lamp that has reduced glare for better reading; and an easy-to-use control panel having a built-in digital clock display that provides the time of day and also allows the user to precisely set the alarm features.

Another advantage of the present invention is that it provides for a reduced glare table lamp having the capability of emitting different background sounds that also includes a standard beeping alarm and clock-radio which allows the user to choose any combination of soothing sound, increasing or decreasing light, beeping alarm, or radio music in order to assist in waking up the user up or helping the user fall asleep.

A further advantage of the present invention is that it provides for a table lamp having an alarm clock-radio with gradually increasing light and/or sounds that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An apparatus for gradually increasing and decreasing light and sounds, comprising:

a. a lighting fixture having at least one lamp for emitting light in a wake-up cycle and in a sleep cycle;

b. said lighting fixture having at least one speaker for emitting sound in the wake-up cycle and in the sleep cycle;

c. a programmable wake-up cycle control for setting and controlling a wake-up cycle including a light control for setting a time period when said wake-up cycle control activates a light mode and gradually increases a lamp brightness emitted from said at least one lamp; a programmable sound control for setting and controlling a time when said wake-up cycle control activates a sound mode and gradually increases a sound intensity emitted from said at least one speaker; and a programmable sound selector for selecting one of multiple pre-set sounds for the sound mode of the wake-up cycle;

d. a programmable sleep cycle control for setting and controlling the sleep cycle including said light control for setting a time period when the sleep cycle control activates the light mode and gradually decreases the lamp brightness emitted from said at least one lamp; a programmable sound control for setting and controlling a time period when said sleep cycle control activates the sound mode and gradually decreases the sound intensity emitted from said at least one speaker; and a programmable sound selector for selecting one of multiple pre-set sounds for the sound mode of the sleep cycle; and e. an electrical circuit connected to said wake-up cycle control and to said sleep cycle control for supplying electrical power thereto.

2. The apparatus in accordance with claim 1, wherein the light control includes a light control button and a plurality of clock set-control buttons for setting a specific time for activating the light mode and said at least one lamp to gradually brighten or dim.

3. The apparatus in accordance with claim 1, wherein said sound control includes a sound control button and a plurality of clock set-control buttons for setting a specific time for activating the sound mode and gradually increase or decrease said sound intensity.

4. The apparatus in accordance with claim 1, wherein said sound selector includes a plurality of sound selection switches for selecting pre-set environmental sounds.

5. The apparatus in accordance with claim 1, further including a mechanism for varying a cycle time for pre-selected time periods from 1 minute to 90 minutes.

6. The apparatus in accordance with claim 1, further including a mechanism for varying cycle time for pre-selected time periods from 15 minutes to 30 minutes.

7. The apparatus in accordance with claim 5, wherein said mechanism for varying the cycle time is in the form of a switch, a dial knob, or a push button for allowing a user to set pre-selected time periods for use in the wake-up cycle and the sleep cycle.

8. The apparatus in accordance with claim 1, further including a dimmer for a clock display.

9. The apparatus in accordance with claim 8, wherein said dimmer is in the form of a switch, a dial knob, or a push button for allowing a user to set a light brightness level on said sleep cycle control.

10. The apparatus in accordance with claim 1, further including an alternate power source in a form of a battery power source for a clock and alarm.

11. The apparatus in accordance with claim 1, further including a radio within said lighting fixture.

12. The apparatus in accordance with claim 1, wherein said lighting fixture further includes a reduced-glare glass shade having an interior reflector.

13. The apparatus in accordance with claim 1, wherein said lighting fixture further includes a fabric shade having an interior reflector.

14. The apparatus in accordance with claim 1, further including sound synthesis microchips for emanating sounds selected from the group consisting of an ocean surf, a water fall, a babbling brook, a tree rustling in the wind, rain drops splattering on a surface, chimes, church bells, a bird singing, a nighttime noise, a forest sound, a harbor sound, a wolf howling, a cricket chirping, rhythmic chanting, a heart beat, a baby cooing, and combinations thereof.

15. The apparatus in accordance with claim 1, wherein said at least one lamp for emitting light is in a form of an incandescent light bulb, a fluorescent lamp, a neon lamp, or a color coated light bulb.

16. The apparatus in accordance with claim 1, wherein said lighting fixture is in a form of a table lamp, a floor lamp, a desk lamp, a ceiling lamp, a shelf lamp, a portable lamp, a wall lamp, or a travel clock with a lamp.

17. The apparatus in accordance with claim 1, wherein said lighting fixture includes a fixture housing made from materials selected from the group consisting of light-weight metals, plastics, ceramics, woods, and combinations thereof.

18. The apparatus in accordance with claim 1, further including an alarm clock having a digital or analog display mode.

19. The apparatus in accordance with claim 1, wherein said wake-up cycle control includes a dimmer switch for dimming light.

20. The apparatus in accordance with claim 1, wherein said sleep cycle control includes sleep cycle control buttons for setting and controlling the sleep cycle.

21. An apparatus for gradually increasing light and sounds, comprising:

a. a lighting fixture having at least one lamp for emitting light in a wake-up cycle;

b. said lighting fixture having at least one speaker for emitting sound in the wake-up cycle;

c. a programmable wake-up cycle control for setting and controlling a wake-up cycle including a light control for setting a time period when said wake-up cycle control activates a light mode and gradually increases a lamp brightness emitted from said at least one lamp; a programmable sound control for setting and controlling a time when said wake-up cycle control activates a sound mode and gradually increases a sound intensity emitted from said at least one speaker; and a programmable sound selector for selecting one of multiple pre-set sounds for the sound mode of the wake-up cycle; and c. an electrical circuit connected to said wake-up cycle control for supplying electrical power thereto.

22. An apparatus for gradually increasing and decreasing light and sounds, comprising:

a. a lighting fixture having at least one lamp for emitting light;

b. said lighting fixture having at least one speaker for emitting sound;

c. a programmable cycle control for setting and controlling a cycle including a light control for setting a time period when said cycle control activates a light mode and gradually increases or decreases a lamp brightness emitted from said at least one lamp; a programmable sound control for setting and controlling a time when said cycle control activates a sound mode and gradually increases or decreases a sound intensity emitted from said at least one speaker; a programmable sound selector for selecting one of multiple pre-set sounds for the sound mode of the cycle; and d. an electrical circuit connected to said cycle control for supplying electrical power thereto.

23. An apparatus for gradually increasing and decreasing light and sounds, comprising:

a. a fixture having a connection for receiving a lamp;

b. said fixture having at least one speaker for emitting sound in a wake-up cycle and a sleep cycle;

c. a wake-up cycle control for setting and controlling the wake-up cycle including a light control for setting a time period when said wake-up cycle control activates a light made and gradually increases a lamp brightness; a sound control for setting and controlling a time when said wake-up cycle control activates a sound mode and gradually increases a sound intensity; and a sound selector for selecting one of multiple pre-set sounds for a sound mode of the wake-up cycle;

d. a sleep cycle control for setting and controlling the sleep cycle including a light control for setting a time period when said sleep cycle control activates a light mode and gradually decreases the lamp brightness; a sound control for setting and controlling a time period when said sleep cycle control activates the sound mode and gradually decreases the sound intensity; and a sound selector for selecting one of multiple pre-set sounds for a sound mode of the sleep cycle; and e. an electrical circuit connected to said wake-up cycle control and to said sleep cycle control for supplying electrical power thereto.

24. An apparatus for gradually increasing light and sounds, comprising:

a. a fixture having a connection for receiving a lamp;

b. said fixture having at least one speaker for emitting sound in a wake-up cycle and a sleep cycle;

c. a wake-up cycle control for setting and controlling the wake-up cyde including a light control for setting a time period when said wake-up cycle control activates a light mode and gradually increases a lamp brightness; a sound control for setting and controlling a time when said wake-up cycle control activates a sound mode and gradually increases a sound intensity; and a sound selector for selecting one of multiple pre-set sounds for a sound mode of the wake-up cycle; and d. an electrical circuit connected to said wake-up cycle control for supplying electrical power thereto.

25. An apparatus for gradually increasing and decreasing light and sounds, comprising;

a. a fixture having a connection for receiving a lamp;

b. said fixture having at least one speaker for emitting sound in a wake-up cycle and a sleep cycle;

c. a cycle control for setting and controlling a cycle including a light control for setting a time period when said cycle control activates a light mode and gradually increases or decreases a lamp brightness; a sound control for setting and controlling a time when said cycle control activates a sound mode and gradually increases or decreases a sound intensity; and a sound selector for selecting one of multiple pre-set sounds for the sound mode of the cycle; and d. an electrical circuit connected to said cycle control for supplying electrical power thereto.

* * * * *